United States Patent [19]

Sasaki

[11] 4,325,646

[45] Apr. 20, 1982

[54] INKRIBBON CARTRIDGE

[75] Inventor: Masao Sasaki, Tokyo, Japan

[73] Assignee: Oki Electric Industry Co., Ltd., Tokyo, Japan

[21] Appl. No.: 119,831

[22] Filed: Feb. 8, 1980

[30] Foreign Application Priority Data

Feb. 16, 1979 [JP] Japan ..... 54-017731[U]

[51] Int. Cl.[3] ..... B41J 32/02

[52] U.S. Cl. ..... 400/196.1; 400/208; 220/346

[58] Field of Search ..... 400/194, 195, 196, 196.1, 400/207, 208, 208.1; 220/345, 346

[56] References Cited

U.S. PATENT DOCUMENTS

| | | | |
|---|---|---|---|
| 2,689,059 | 9/1954 | Nudell | 220/346 |
| 3,187,926 | 6/1965 | Zimmet | 220/346 |
| 3,260,344 | 7/1966 | Doyle | 400/202 |
| 3,726,381 | 4/1973 | Murphy | 400/196.1 |
| 3,758,012 | 9/1973 | Bonner et al. | 400/196 |
| 3,830,351 | 8/1974 | Cappotto | 400/196 |
| 3,974,906 | 8/1976 | Lee et al. | 400/196.1 |
| 4,048,050 | 9/1977 | Hillman | 220/346 |
| 4,120,400 | 10/1978 | Kotyuk | 206/1.5 |
| 4,146,278 | 3/1979 | Seitel | 220/345 |
| 4,161,270 | 7/1979 | Casey | 400/195 |

FOREIGN PATENT DOCUMENTS

| | | | |
|---|---|---|---|
| 349276 | 11/1960 | Switzerland | 400/208.1 |
| 766357 | 1/1957 | United Kingdom | 220/346 |

*Primary Examiner*—William Pieprz

*Attorney, Agent, or Firm*—Berger & Palmer

[57] ABSTRACT

An inkribbon cartridge for a printer is disclosed which compulsorily keeps a definite form by a cooperation with its box member and a lid member.

The box member which comprises a plurality of concavities on the outside of a wall and a plurality of projections on the upper end of the wall near the concavities is engaged with the lid member which comprises a plurality of hooks which is inserted in the concavities to prevent outward deformation of the wall and a plurality of cuts which associate with the projections to prevent inward deformation of the wall.

By these provisions, in- and outward deformations of the wall of the box member can be undertaken by the lid member and the inkribbon cartridge compulsorily keeps its definite form.

3 Claims, 7 Drawing Figures

INKRIBBON CARTRIDGE

BACKGROUND OF THE INVENTION

A. Field of the Invention

The present invention relates to an inkribbon cartridge for a printer, or more precisely, to the inkribbon cartridge which compulsorily keeps a definite form by a cooperation with its box member and a lid member.

B. Description of the Prior Art

In a ribbon feed mechanism of a printer, an endless inkribbon is stored in an inkribbon cartridge randomly or orderly to be fed successively for printing by a feeding mechanism of the printer. The inkribbon cartridge is mainly composed of a box member and a lid member. A storing portion whose depth is substantially equal to the width of the inkribbon is provided in the box member which has an exit and an inlet for the inkribbon. A plane lid member engages with the box member to complete the inkribbon cartridge.

When the inkribbon is exhausted, the inkribbon cartridge should be exchanged for the next one. Accordingly, it is desirable that the inkribbon cartridge is inexpensive and can be easily mounted on the feeding mechanism and the like.

For this reason, the inkribbon cartridge is in general made of molded plastic resin. But, the inkribbon cartridge, being substantially as long as the printing width, is easily distorted in molding process or by external force. For example, the wall of the box member tends to be bent toward the bottom of the box member or the shape of the inkribbon cartridge is easily deformed. Following that, it becomes difficult to couple the box member with the lid member and, in extreme cases, the shape of the inkribbon cartridge differs with that of predetermined one.

In order to improve the fitness to the feeding mechanism and the like, the shape of the inkribbon cartridge should be arranged according to design. But, there are conflicting problems that, when the extreme accuracy of the molded plastic is required, a special plastic resin and a die for molding is needed. In addition, the cost for production raises by increasing the thickness of the wall or by inferior goods. Moreover, it is not sufficient merely to increase the thickness of the wall or the provision of reinforcement.

In the prior arts, a plurality of projections are provided on the wall of the box member and the projections are inserted into a plurality of holes of the lid member in order to couple them together.

In the above-described construction, however, the contact position of the molded plastic members disagree with each other. So, it is difficult to insert all the projections into holes. The wall of the box member is distorted thereupon and the close fit to the feeding mechanism can not be realized on account of unexpected shape.

SUMMARY OF THE INVENTION

Upon study of the box member and the lid member of the inkribbon cartridge, it is inevitable that the wall of the box member is distorted to a certain extent. However, the wall can compulsorily be regulated by the plane lid member which withstands the tension and compression force.

Accordingly, it is an object of the invention to obtain an inkribbon cartridge which keeps its definite form without an extreme accuracy of the dimension.

It is another object of the invention to obtain an inkribbon cartridge by which the box member can be well-fitted with the lid member.

Further object of the invention is to obtain an inkribbon cartridge which can easily be adapted to other mechanisms of a printer.

Another object of the invention is to obtain an inkribbon cartridge which is inexpensive and has sufficient mechanical strength.

To achieve the objects, the present invention is characterized by the provision of a plurality of concavities on the outside of the wall of the box member, a plurality of projections on the upper end of the wall, a plurality of hooks which are inserted in the concavities to prevent outward deformation of the wall and a plurality of cuts which associate with the projections to prevent inward deformation of the wall. By these provisions, in- and outward deformation forces of the wall can be withstood by the lid member which comprises hooks and cuts and the ink ribbon cartridge compulsorily keeps its definite form.

The above and further objects and novel features of the invention will more fully appear from the following detailed description when the same is read in connection with the accompanying drawings. It is to be expressly understood, however, that the drawings are for purpose of illustration only and are not intended as a definition of the invention.

DETAILED DESCRIPTION OF PREFERRED EMBODIMENT

Figure 1:
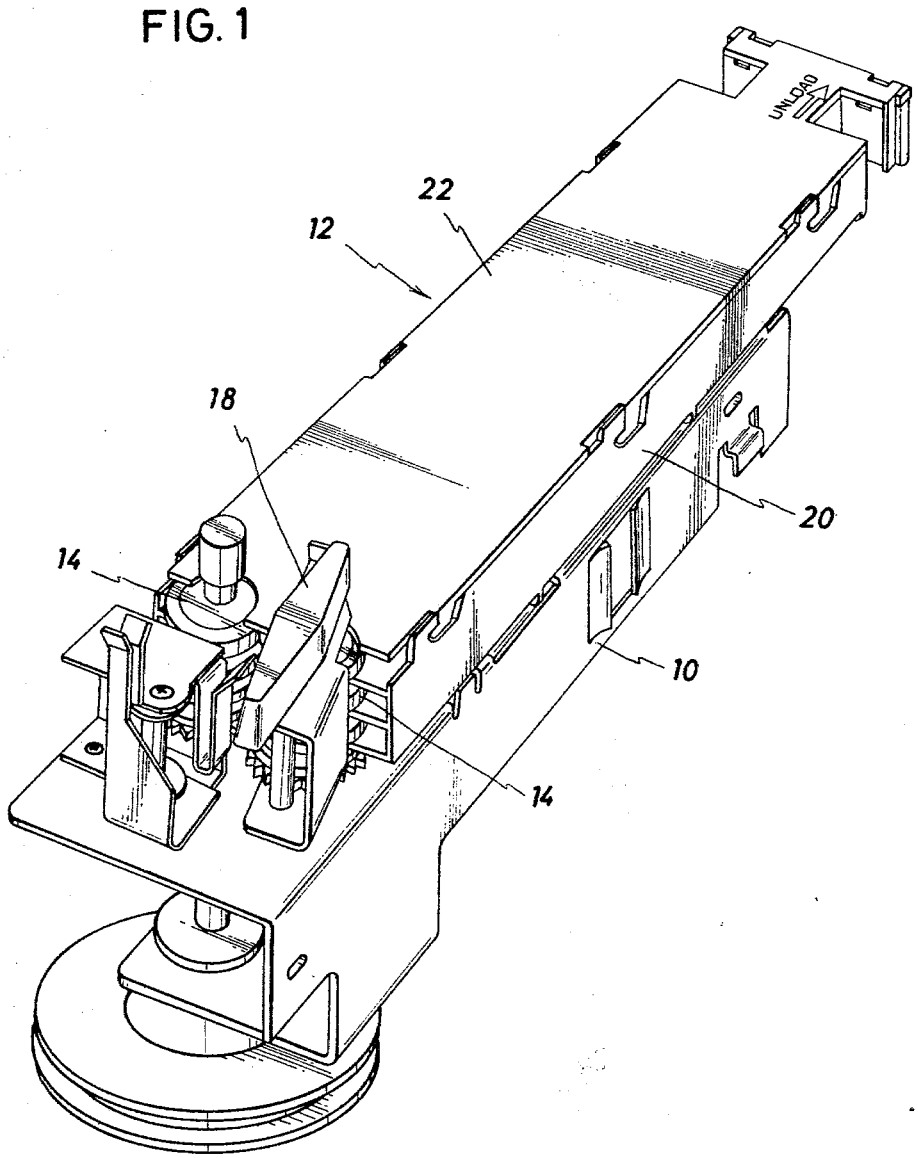
FIG. 1 is a perspective view illustrating an inkribbon cartridge of a printer according to the present invention which is mounted on a feeding mechanism of the printer.

FIG. 1 illustrates an embodiment of an inkribbon cartridge which is mounted on a feeding mechanism of a dot line printer. The dot line printer in general presses an inkribbon to a printing paper to effect printing each line. In the dot printer, a plurality of printing elements are arranged perpendicular to the printing paper. The printing paper and the inkribbon are positioned between a platen and the printing elements to effect printing by driving the printing elements. In the figure, numeral 10 indicates a base of the feeding mechanism and a L-shaped pawl (not shown) for engaging the bottom of the inkribbon cartridge 12 is provided under the base 10. Numeral 14 indicates a drive roller for drawing the endless inkribbon 16 into the inkribbon cartridge 12. Numeral 18 indicates a set lever for attaching the inkribbon cartridge 12 to the base 10. A box member 20 is in combination with a lid member 22 to store the inkribbon 16 therein. In the line printer, printing is effected in a line at a time. Accordingly, the inkribbon 16 which is longer than the printing width is required at a time. The inkribbon cartridge 12 should have enough strength and, when mounted on the base 10, it should keep its definite form.

Figure 2:
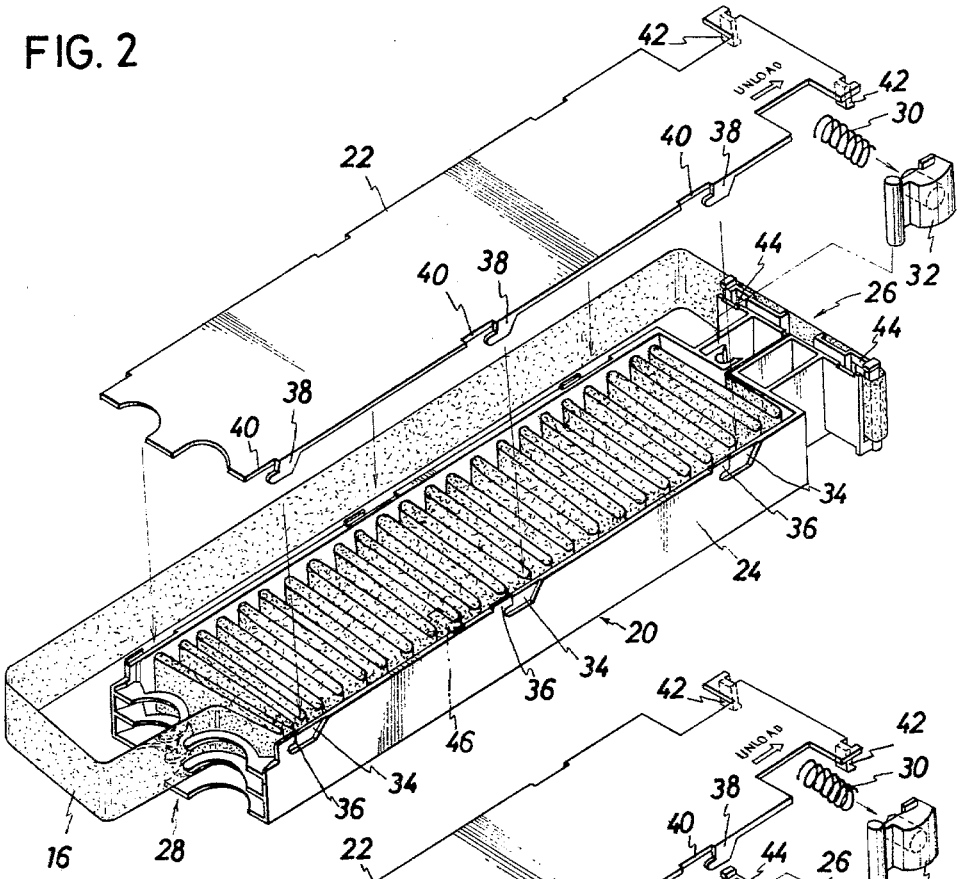
FIG. 2 is a perspective view in which a box member and a lid member are separated from each other.

In FIG. 2, the lid member 22 of the inkribbon cartridge 12 is separated from the box member 20 which stores the inkribbon 16 randomly or orderly. A storing portion whose depth is substantially equal to the width of the inkribbon 16 is formed by a wall 24 of the box member 20. The inkribbon 16 is stored randomly or orderly in said storing portion between an exit 26 at the end of the box member 20 and an entrance 28 at the side of the drive roller 14. A frictional drag member 32 is positioned at the exit 26. Said member 32 is pivotable and is pressed to the inkribbon 16 by a spring 30. The inkribbon 16 is restained by the member 32 to be opposite the platen and the printing paper with a tension force. Many other methods are applicable for pulling out the inkribbon 16.

Figure 3:
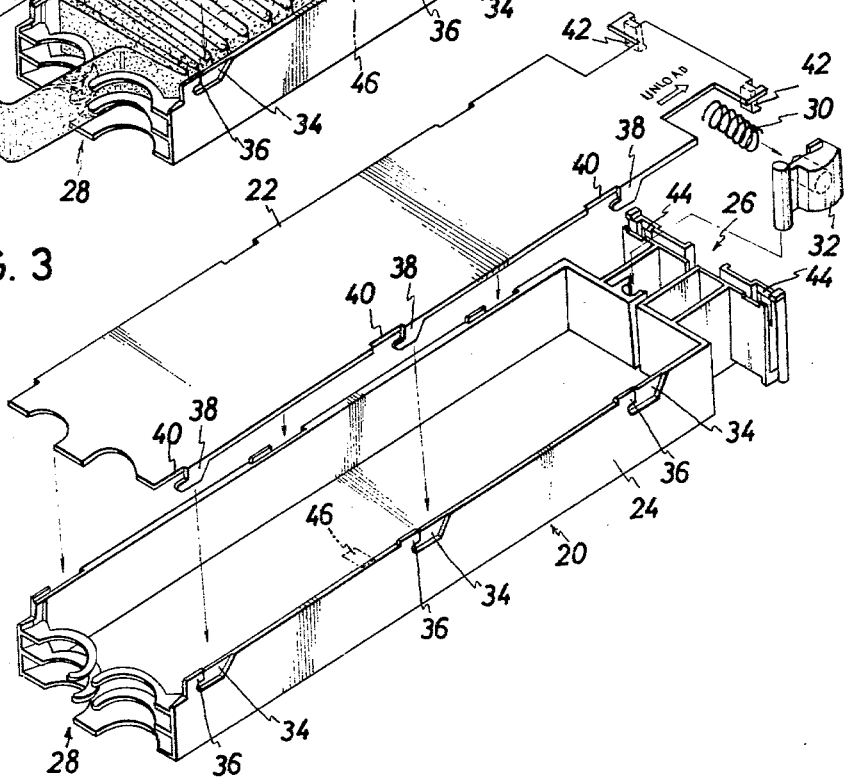
FIG. 3 is a perspective view illustrating an inkribbon cartridge according to the present invention.
Figure 4:
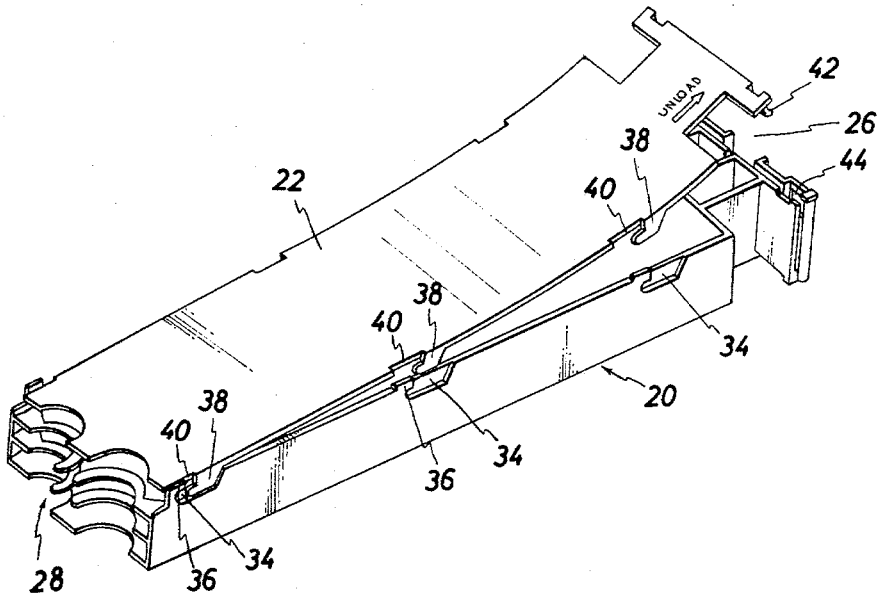
FIG. 4 is a perspective view in which the lid member is going to engage with the box member.
Figure 5:
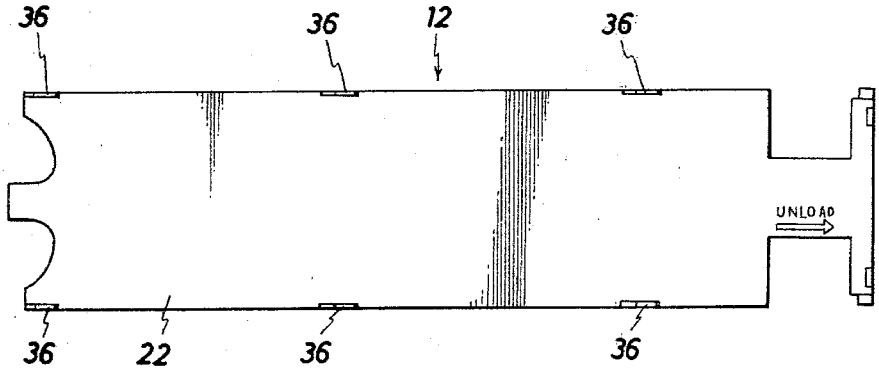
FIG. 5 is a plan view of FIG. 4.
Figure 6:
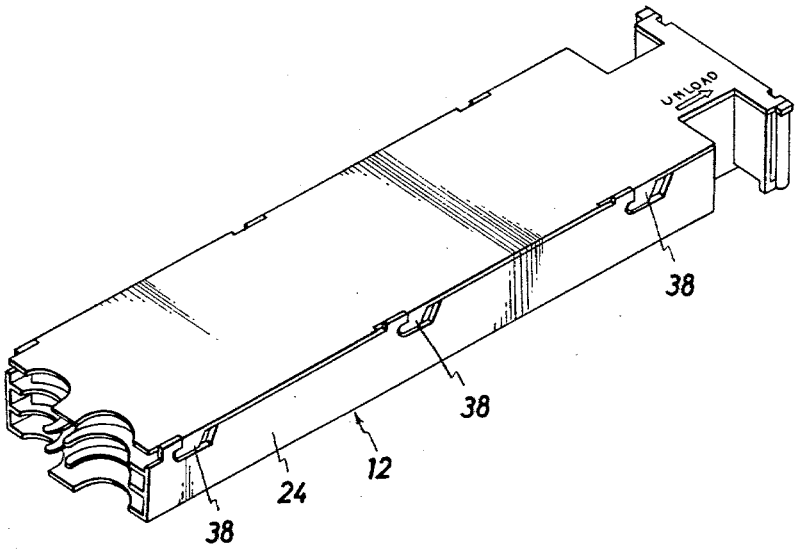
FIG. 6 is a perspective view in which a lid member is coupled with the box member.
Figure 7:
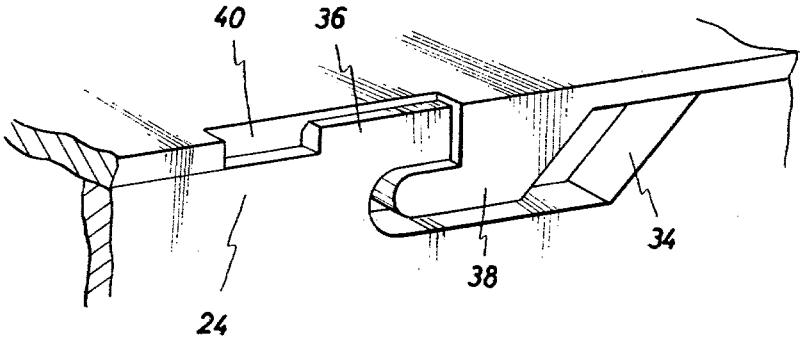
FIG. 7 is an enlarged perspective view of the contact portion of the lid member and the box member.

The structure of the inkribbon cartridge 12 is now detailed hereinunder with reference to FIG. 3. The box member 20 and the lid member 22 of the inkribbon cartridge 12 are made of molded plastic resin, for examle, ABS resin (copolymer of acrylonitrile butadiene stylene resin) and the plane lid member 22 is associated with the box member 20 to complete the inkribbon cartridge 12. As is described, the box member 20 includes the storing portion for the inkribbon 16 by the wall 24. A plurality of concavities 34 and projections 36 are provided on the wall 24. The concavities 34 are positioned on the outside of the wall 24 and the projections 36 on the upper end of the wall 24 near the concavities 34. In compliance with the concavities 34 and the projections 36, the lid member 22 includes a plurality of hooks 38 and cuts 40. The hook 38 is of a dog ear shape and it hangs down from the side of the lid member 22. When inserted into the concavities 34, the hooks 38 prevent an outward deformation of the wall 24. In other words, the wall 24 which would have been curved in the outward direction is pressed inward by the hooks 38. The upper end of the cut 40 is in accord with the end of the hook 38. When the cut abuts to the projection 36 of the wall 24, the wall 24 is pressed in an outward direction. That is, an outward deformation of the wall 24 can be reformed. The upper end of the projection 36 is so designed that it is of the same height as the surface of the lid member 22. The forward end of the concavity 34 is positioned at the downward of the projection 36.

Numerals 42 and 44 indicate a pawl and a hole of locking means for preventing a reverse movement of the lid member 22. They are positioned near the exit 26 of the inkribbon cartridge 12. Numeral 46 indicates a connecting portion at the bottom of the inkribbon cartridge 12 to which the pawl of the base 10 engages.

Referring now to FIGS. 4 to 7, an operation of the embodiment will be detailed hereinunder. In order to associate the lid member 22 with the box member 20, the hooks 38 are inserted, slightly missing it out of position, into the concavities. Then, the lid member 22 is guided by the hooks 38 and slide from the direction of exit 26 to the entrance 28. The hooks 38 then associate with the concavities 34 and the projections 36 with the cuts 40. In this way, a horizontal play of the lid member 22 can be eliminated. Finally, the pawls 42 of the locking means are inserted into holes 44. Thus, the reverse movement of the lid member 22 can be prevented and the inkribbon cartridge 12 is completed by a cooperation with its box member 20 and the lid member 22.

In case the wall 24 is curved, a force for correcting in- and outward deformation of it to the shape to be expected is generated by the hooks 38 and the cuts 40. Therefore, the inkribbon cartridge 12 compulsorily keeps its definite form.

For separating the lid member 22 from the box member 20, the pawls 42 of the locking means are pulled out from the holes 44 to slide the lid member 22 in the direction of the exit 26.

In conclusion, in- and outward deformation of the wall 24 of the box member can be undertaken by the lid member 22 and the inkribbon cartridge 12 compulsorily keeps its definite form by the provision of concavities 34, projections 36, hooks 38 and cuts 40. In addition, the inkribbon cartridge according to the present invention is inexpensive and has sufficient mechanical strength.

While there have been shown and described and pointed out the fundamental novel features of the invention as applied to the preferred embodiment. It will be understood however that the various omissions and substitutions and changes in the form and details may be made by those skilled in the art without departing from the spirit of the invention.

What is claimed is:

1. In an inkribbon feed mechanism of a printer for successively feeding an inkribbon by a feeding mechanism, comprising a box member having opposite sidewalls and comprising a storing portion whose depth is substantially equal to the width of said inkribbon and has exit and inlet means for said inkribbon and a planar lid member which engages with said box member to complete the inkribbon cartridge, wherein the improvement comprises a plurality of spaced apart recesses formed in the outside of said sidewalls and extending from the top of said sidewalls downwardly and forwardly, a plurality of spaced apart projections formed between the forward portions of each of said recesses and the top of said sidewalls and projecting above the top of said sidewalls, said planar lid member comprising a plurality of hooks extending from said lid member which are inserted into said recesses bearing against the recessed portions of said sidewalls to prevent outward deformation of said sidewall, said planar lid member further comprising a plurality of cutouts which engage with said projections to prevent inward deformation of said wall, said inkribbon cartridge maintaining its form when said box member and lid member are engaged together.

2. An invention of claim 1, wherein said hook is of a generally V-shaped configuration and said hook is inserted into said recessed portion of said sidewall to prevent the rise of said lid member.

3. An invention of claim 1 or 2, further comprising lock means for preventing a reverse movement of said lid member to prevent said lid member from slipping out of engagement with said box member.

* * * * *